US011230777B2

(12) United States Patent
Smith et al.

(10) Patent No.: US 11,230,777 B2
(45) Date of Patent: Jan. 25, 2022

(54) WEAR-RESISTANT COATING

(71) Applicant: Hamilton Sundstrand Corporation, Charlotte, NC (US)

(72) Inventors: Blair A. Smith, South Windsor, CT (US); Claude J. Moreau, Vernon, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 50 days.

(21) Appl. No.: 16/447,302

(22) Filed: Jun. 20, 2019

(65) Prior Publication Data

US 2020/0399773 A1 Dec. 24, 2020

(51) Int. Cl.

| | |
|---|---|
| ***C25D 3/06*** | (2006.01) |
| ***B05D 7/14*** | (2006.01) |
| ***C25D 5/50*** | (2006.01) |
| ***C25D 5/54*** | (2006.01) |
| ***C25D 5/34*** | (2006.01) |

(52) U.S. Cl.

CPC ..... *C25D 3/06* (2013.01); *B05D 7/14* (2013.01); *C25D 5/34* (2013.01); *C25D 5/50* (2013.01); *C25D 5/54* (2013.01); *B05D 2504/00* (2013.01); *B05D 2505/50* (2013.01); *B05D 2506/10* (2013.01); *B05D 2601/00* (2013.01)

(58) Field of Classification Search

CPC ..... C25D 3/04–10; C25D 11/36; C25D 5/50; C23C 22/24–33; C23C 2222/10

See application file for complete search history.

(56) References Cited

U.S. PATENT DOCUMENTS

| | | | | |
|---|---|---|---|---|
| 4,159,230 | A | 6/1979 | Barnes et al. | |
| 4,347,287 | A * | 8/1982 | Lewis | B29C 70/525 264/136 |
| 5,480,536 | A * | 1/1996 | Suehiro | C25D 5/50 205/151 |
| 7,101,589 | B1 * | 9/2006 | Hawkins | B05D 7/51 427/309 |
| 10,100,423 | B2 | 10/2018 | Hall et al. | |
| 2011/0151126 | A1 | 6/2011 | Metts et al. | |
| 2014/0017409 | A1 | 1/2014 | Kulkarni et al. | |

(Continued)

FOREIGN PATENT DOCUMENTS

| | | | |
|---|---|---|---|
| CN | 104532306 | A * | 4/2015 |
| EP | 0217126 | A1 | 4/1987 |

(Continued)

OTHER PUBLICATIONS

Yin, Machine Translation, CN-104532306-A. (Year: 2015).*

Extended European Search Report for EP Application No. 19211210.0, dated Jun. 22, 2020, 9 pages.

*Primary Examiner* — Ho-Sung Chung

(74) *Attorney, Agent, or Firm* — Kinney & Lange, P.A.

(57) ABSTRACT

A method of forming a wear-resistant coating on an article includes depositing a chromium coating on a substrate of the article, and subsequently heating the coated article to enhance a plurality of through-cracks within the chromium coating. The method further includes applying a liquid filler material to the coated article such that at least one of the plurality of through-cracks is at least partially occupied by the filler material, and solidifying the liquid filler material.

6 Claims, 2 Drawing Sheets

(56) References Cited

U.S. PATENT DOCUMENTS

| | | | | |
|---|---|---|---|---|
| 2015/0218703 | A1* | 8/2015 | Okabe | B32B 33/00 205/113 |
| 2016/0153287 | A1* | 6/2016 | Roach | F04D 29/322 415/119 |
| 2018/0010689 | A1* | 1/2018 | Toth | F16J 9/26 |

FOREIGN PATENT DOCUMENTS

| | | | |
|---|---|---|---|
| EP | 0892088 | A2 | 1/1999 |
| EP | 2896499 | A1 | 7/2015 |

* cited by examiner

WEAR-RESISTANT COATING

BACKGROUND

Wear resistant coatings are required where two parts slide against one another. One common coating deposition process utilizes a hexavalent chromium ($Cr^{6+}$) containing electrolyte. Hexavalent chromium has been subject to increasingly stringent global environmental regulations due to its carcinogenic and toxic nature. Alternative deposition techniques using environmentally favorable trivalent chromium ($Cr^{3+}$) have been developed, but the resulting coatings can exhibit greater and/or wider through-cracks compared to the hexavalent coatings. Such cracks can cause decreased coating wear resistance and can additionally provide a path for corrodents to reach the underlying substrate. Thus, the need exists for a wear and corrosion resistant trivalent chromium coating.

SUMMARY

A method of forming a wear-resistant coating on an article includes depositing a chromium coating on a substrate of the article, and subsequently heating the coated article to enhance a plurality of through-cracks within the chromium coating. The method further includes applying a liquid filler material to the coated article such that at least one of the plurality of through-cracks is at least partially occupied by the filler material, and solidifying the liquid filler material.

A coated article includes a substrate and a wear-resistant coating in communication with the substrate. The wear-resistant coating includes a chromium coating having a plurality of through-cracks and deposited on the substrate, and a solidified filler material in communication with the chromium coating and at least partially occupying at least one of the plurality of through-cracks.

DETAILED DESCRIPTION

A method of forming a wear-resistant coating is disclosed herein. The method includes applying a trivalent chromium coating to an article substrate and heating the article to enhance (i.e., enlarge and/or increase the number of) cracks within the coating. A liquid filler material is subsequently applied to fill the cracks, and once solidified, forms a wear resistant coating. The filler material can be a fluorocarbon, polymide, and/or epoxy-based material and can include particulate additives to enhance the mechanical properties of the filler material.

Figure 1:
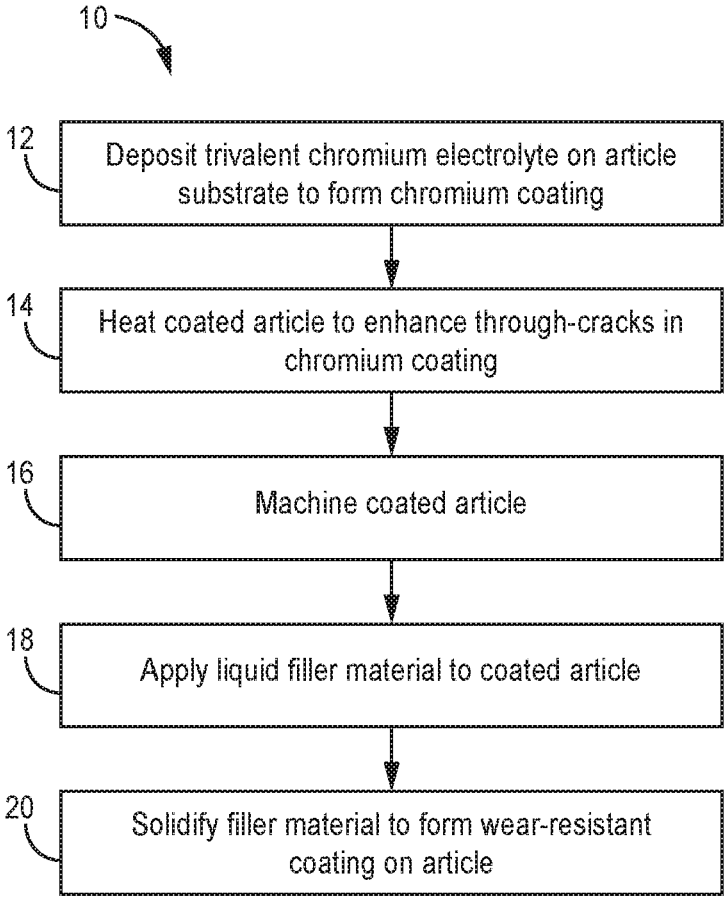
FIG. 1 is flowchart illustrating a method of forming a wear resistant coating on an article.
Figure 2:
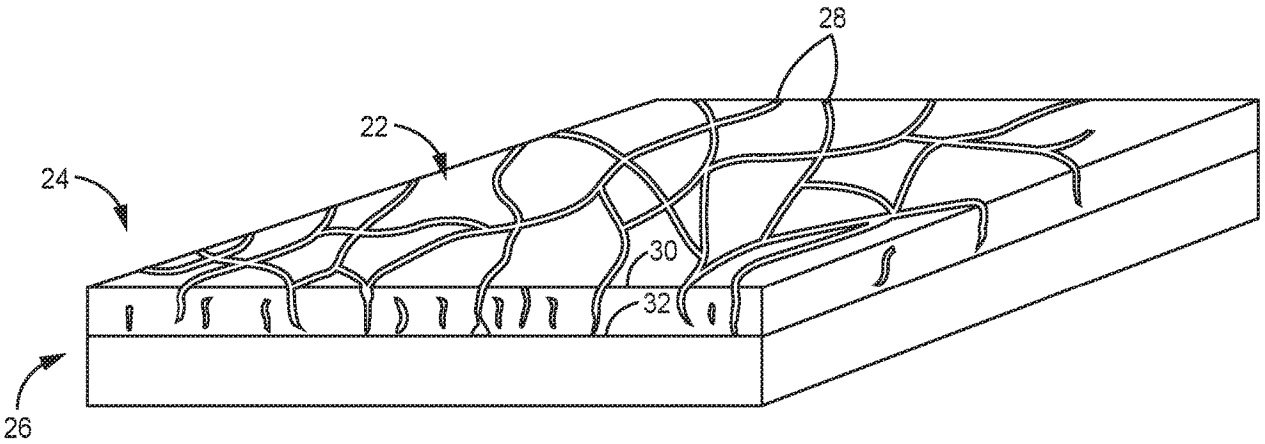
FIG. 2 is a cross-sectional view of the article with an initial chromium coating.
Figure 3:
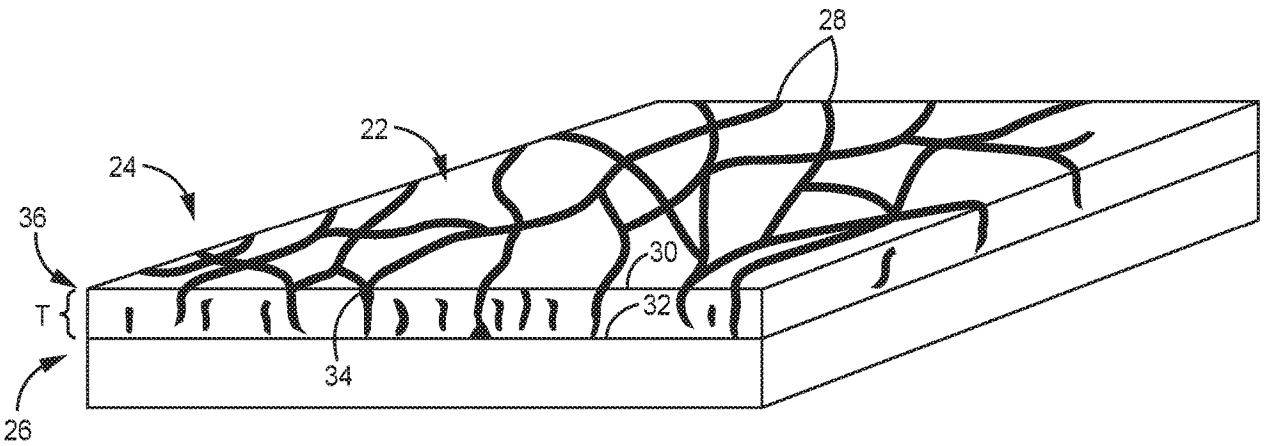
FIG. 3 is a cross-sectional view of the chromium coated article after application of the filler material.

FIG. 1 is a flow diagram illustrating selected steps of method 10, used to produce a wear resistant coating. FIGS. 2 and 3 are simplified cross-sectional views of the coating applied to an article substrate at various stages of method 10.

At step 12, chromium coating 22 is applied to substrate 26 of article 24. Article 24 can be, for example, a hydraulic component such as a cylinder or actuator with a metallic substrate 26. Components having plastic or ceramic substrates are also contemplated herein. Chromium coating 22 can be formed using an electroplating process such as the FARADAYIC® process using a trivalent chromium electrolyte bath. Other suitable deposition processes using trivalent chromium ions are contemplated herein. Coating properties (e.g., thickness, hardness, coverage, etc.) can be controlled, for example, by temperature or current density in the bath, as well as length of time in the plating solution at a given current density. The resulting chromium coating 22 can have greater and/or wider through-cracks than one formed with hexavalent chromium, and without further processing, may not be suitable for harsh operating environments.

At step 14, the coated article 24 is heated to enhance cracks in coating 22. Coated article 24 can be heated to a temperature of up to 1000° F. depending on the material of substrate 26. For example, various types of steel, titanium alloys, nickel alloys, and cobalt alloys can be heated to temperatures ranging from about 475° F. (246° C.) to about 800° F. (427° C.), while aluminum substrates can be heated in the range of about 205° F. (96° C.) to about 400° F. (204° C.). For plastics, a suitable temperature can range from 0-50° F. below the glass transition temperature ($T_g$) of the plastic. Heating to the appropriate temperature can achieve the desired degree of cracking, based on additional factors such as the thickness and hardness of the particular chromium coating 22 and substrate 26, as well as the material of substrate 26. FIG. 2 shows substrate 26 of article 24 with chromium coating 22 after the heat treatment of step 14. Coating 22 has a number of cracks 28 extending, to various degrees, through coating 22. For example, some of the cracks 28 extend from the outer surface 30 of coating 22 to the outer surface 32 of substrate 26. The presence of cracks 28 can decrease stresses at the interface of coating 22 and substrate 26, but can also provide a path for external corrodents to reach substrate 26 if left open/untreated. Additionally, open cracks 28 have the potential to weaken coating 22 and/or damage other components with which coating 22 comes into sliding contact, due to rough/sharp edges. At step 16, chromium coating 22 can optionally undergo a machining/polishing process to refine the coating for subsequent steps of method 10. In some embodiments, the machining step can precede the heating step, and the ordering of the heating and machining steps can be based upon such factors as substrate material and hardness, as some materials require heating more quickly after electroplating than others.

At step 18, filler material 34 can be applied to chromium coating 22 to fill cracks 28. Filler material 34 can be a relatively high-temperature and low friction coefficient material. Exemplary materials include fluoropolymers such as polytetrafluoroethylene (PTFE) (e.g., Teflon™), graphite-filled polyimide resins (e.g., Vespel®), epoxy resins, and epoxy or phenolic-based dry film lubricants further containing materials like graphite, molybdenum disulfide, indium, antimony, silver, or lead. A corrosion-inhibiting zinc or aluminum silicate material can alternatively or additionally be used. Each of the aforementioned filler materials can also include nano-particulate materials like silicon carbide, boron nitride, chromium carbide, tungsten carbide, and/or diamond to enhance the material's mechanical properties. Larger particles (i.e., >100 nm) could additionally or alternatively be used so long as the dimensions of cracks 28 can accommodate such particles. Filler material 34 can be applied as a liquid using a suitable application technique such as spraying, painting, filming, or dip-coating to name a few, non-limiting examples. A vacuum can be applied to all or portions of the coated substrate to facilitate the filling of cracks 28. One application may be suitable to fill cracks 28 to the extent desired, but additional rounds can be carried out as necessary. As is shown in FIG. 3, filler material 34 can come into contact with substrate 26 through those cracks 28 extending completely through coating 22.

At step 20, filler material 34, as applied to cracks 28 and coating 22 is solidified/hardened using a curing technique using, for example, one or a combination of heat, chemical additives, or an electron beam. Once the filler material has cured, the chromium coating 22 with filled cracks 28 creates wear-resistant coating 36, as shown in FIG. 3. After step 20, additional post-processing/finishing steps (not listed in FIG. 1) can be carried out to create the desired shape, thickness, smoothness, etc. of wear-resistant coating 36 and article 24. Wear resistant coating can have a thickness T ranging from about 2 microns to about 250 microns, and in some embodiments, can exceed 250 microns, based on factors such as operating environment, finish/tolerance, and functional requirements of article 24. Wear resistant coating 36 can be suitable for operating environments having temperatures of up to 600° F. (316° C.) or greater, depending on factors such as coating thickness and the particular composition of substrate 26 and/or filler material 34.

The disclosed method produces an environmentally favorable wear-resistant chromium coating that can have additional properties (e.g., enhanced lubricity and/or corrosion resistance) ideal for use in high-temperature and/or high-friction environments. The method capitalizes on the tendency of trivalent chromium coatings to form through-cracks by utilizing the cracks to introduce lubricious, corrosion-resistant materials into the chromium coating. The resulting wear-resistant coating can be used in aerospace, industrial, and other transportation applications.

Discussion of Possible Embodiments

A method of forming a wear-resistant coating on an article includes depositing a chromium coating on a substrate of the article, and subsequently heating the coated article to enhance a plurality of through-cracks within the chromium coating. The method further includes applying a liquid filler material to the coated article such that at least one of the plurality of through-cracks is at least partially occupied by the filler material, and solidifying the liquid filler material.

The method of the preceding paragraph can optionally include, additionally and/or alternatively, any one or more of the following features, configurations and/or additional components:

In the above method, the chromium coating can be electrodeposited from a trivalent chromium electrolyte.

In any of the above methods, the heating step can be performed at a temperature ranging from about 205° F. to about 800° F.

In any of the above methods, the filler material can be a material selected from the group consisting of fluoropolymers, epoxy resins, polyimide resins, epoxy-based film lubricants, phenolic-based film lubricants, and combinations thereof.

In any of the above methods, the filler material can further include particulate materials selected from the group consisting of silicon carbide, boron nitride, chromium carbide, tungsten carbide, diamond, and combinations thereof.

Any of the above methods can further include the step of machining the coated article prior to applying the material.

In any of the above methods, the solidifying step can include curing the filler material using heat, chemical additives, or an electron beam.

In any of the above methods, each of the plurality of through-cracks can be at least partially occupied by the filler material.

A coated article includes a substrate and a wear-resistant coating in communication with the substrate. The wear-resistant coating includes a chromium coating having a plurality of through-cracks and deposited on the substrate, and a solidified filler material in communication with the chromium coating and at least partially occupying at least one of the plurality of through-cracks.

The article of the preceding paragraph can optionally include, additionally and/or alternatively, any one or more of the following features, configurations and/or additional components:

In the above article, the substrate can be formed from one of a metallic, plastic, and ceramic material.

In any of the above articles, the chromium coating can be electrodeposited from a trivalent chromium electrolyte.

In any of the above articles, the solidified filler material can be a material selected from the group consisting of fluoropolymers, epoxy resins, polyimide resins, epoxy-based film lubricants, phenolic-based film lubricants, and combinations thereof.

In any of the above articles, the solidified filler material can further include particulate materials selected from the group consisting of silicon carbide, boron nitride, chromium carbide, tungsten carbide, diamond, and combinations thereof.

In any of the above articles, the at least one of the plurality of through-cracks can extend through the chromium coating to the substrate, and wherein the solidified filler material within the at least one of the plurality of through-cracks can be in communication with the substrate.

In any of the above articles, the solidified filler material can at least partially occupy the plurality of through-cracks.

In any of the above articles, wherein the wear-resistant coating can have a thickness ranging from about 2 microns to about 250 microns.

In any of the above articles, the wear-resistant coating can have a thickness exceeding 250 microns.

In any of the above articles, the wear-resistant coating can be suitable for use in a hydraulic system.

In any of the above articles, wherein the wear-resistant coating can be suitable for use in operating temperatures of up to 600° F.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A method of forming a wear-resistant coating on an article, the method comprising:

depositing a trivalent chromium coating on the article, the article comprising a plastic material with a glass transition temperature;

heating the coated article to a temperature up to 50° F. below the glass transition temperature of the plastic material to enhance a plurality of through-cracks within the chromium coating;

applying a liquid filler material to the coated article such that at least one of the plurality of through-cracks is at least partially occupied by the filler material; and solidifying the liquid filler material, and wherein the liquid filler material is selected from the group consisting of fluoropolymers, epoxy resins, polyimide resins, epoxy-based film lubricants, phenolic-based film lubricants, and combinations thereof, wherein the filler material further comprises particulate materials selected from the group consisting of silicon carbide, boron nitride, chromium carbide, tungsten carbide, diamond, and combinations thereof.

2. The method of claim 1, wherein the trivalent chromium coating is electrodeposited from a trivalent chromium electrolyte.

3. The method of claim 1, wherein applying the filler material comprises a spraying, painting, filming, or dip-coating technique.

4. The method of claim 1 and further comprising: machining the coated article prior to applying the material.

5. The method of claim 1, wherein the solidifying step comprises curing the filler material using heat, chemical additives, or an electron beam.

6. The method of claim 1, wherein each of the plurality of through-cracks is at least partially occupied by the filler material.

* * * * *